United States Patent [19]

Buxbaum et al.

[11] 4,019,081

[45] Apr. 19, 1977

[54] REACTION CATHODE

[75] Inventors: Charley Buxbaum, Baden; Gernot Gessinger, Bublikon, both of Switzerland

[73] Assignee: BBC Brown Boveri & Company Limited, Baden, Switzerland

[22] Filed: Oct. 6, 1975

[21] Appl. No.: 620,175

[30] Foreign Application Priority Data

Oct. 25, 1974 Sweden ..... 7414295

[52] U.S. Cl. ..... 313/346 R; 252/521; 428/77; 313/337; 313/346 DC

[51] Int. Cl.[2] ..... H01J 1/14; H01J 19/06

[58] Field of Search ..... 313/346, 346 DC, 336, 313/337; 428/77; 252/521

[56] References Cited

UNITED STATES PATENTS

| | | | |
|---|---|---|---|
| 3,134,924 | 5/1964 | Henderson et al. | 313/346 R |
| 3,155,864 | 11/1964 | Coppola | 313/346 R |
| 3,437,865 | 4/1969 | Gabor et al. | 313/346 R |
| 3,454,816 | 7/1969 | Hoffmann et al. | 313/346 R |
| 3,497,757 | 2/1970 | Zalm et al. | 313/346 R |
| 3,631,291 | 12/1971 | Favreau | 313/346 |
| 3,823,337 | 7/1974 | Van Stratum et al. | 313/346 R |
| 3,833,494 | 9/1974 | Van Stratum et al. | 313/346 R |

*Primary Examiner*—Saxfield Chatmon, Jr.
*Attorney, Agent, or Firm*—Oblon, Fisher, Spivak, McClelland & Maier

[57] ABSTRACT

A reaction cathode with high thermic emission which is especially suited for vacuum tube application and which contains a compound of a monolayer forming element which is liberated by a supply reaction which proceeds during the operation of the cathode, wherein the monolayer forming element is at least one of the elements selected from the group consisting of yttrium and lanthanum, and wherein said cathode further contains at least one metal selected from the group consisting of palladium, platinum, rhodium and ruthenium, as a diffusion-enhancing agent.

10 Claims, 4 Drawing Figures

*CLASSIFICATION ACCORDING TO PROPERTIES IN THE OPERATING STATE*

REACTION CATHODE

BACKGROUND OF THE INVENTION

1. Field of the Invention

The present invention relates to a reaction cathode characterized by a high thermic emission, which is especially suited for use in vacuum tubes. More particularly, this invention relates to a reaction cathode having a composition containing an emitting, monolayer-forming element which is liberated from the compound by a reaction occurring during cathode operation.

2. Description of the Prior Art

In general, reaction cathodes are known. In these known cathodes, the monolayer (monoatomic surface layer) is stored as a reserve supply in chemically bound form and is steadily liberated from this compound by an appropriately induced reaction throughout the lifetime of the cathode. The rate of the reaction is commensurate with the evaporation rate of the monolayer during the cathode operation, which enables the formation of a monolayer which is sufficient for the desired electron emission current density, as a coating on the cathode in the stationary state.

This type of monolayer-forming reaction cathode is quite equivalent in function to the more common reactionless cathode commonly used for electron emission — after, of course, some form of activation before being put into operation. To this latter type belong, together with the direct emitting, i.e. without a monolayer cathode (e.g., direct emitting cathodes made from a refractory metal), also certain monolayer-cathodes, viz. alloy cathodes and those storage cathodes in which a monolayer-forming metal is physically stored by capillary action. It is characteristic of the reactionless cathode that the emitting or monolayer-forming substance is present in the cathode in direct emitting or physically stored form and does not have to be continuously liberated from a compound by a supply reaction. In contrast to refractory pure metal cathodes, which permit only low emission current densities, alloy cathodes, for example, allow quite high emission current densities to be obtained; however, the lifetime is insufficient for use in vacuum tubes and is not comparable to those of, e.g., the usual tungsten-tungsten carbide-thorium oxide cathodes.

In FIG. 1 of the attached drawings is a schematic survey of the cathode types mentioned up to now with a further subdivision of the present monolayer-reaction cathode types. Accordingly, the latter type (heavily outlined area in FIG. 1) includes first the group of cathodes utilizing thermal decomposition of an active substance with release of a monolayer-forming element — called "thermal decomposition cathodes" for short — and the group of cathodes utilizing a reaction partner in the chemical supply and release reaction — referred to as "conversion cathodes".

In the thermal decomposition cathodes, the monolayer former is released from an active substance by a, completely or at least essentially, thermally determined decomposition reaction. Examples of this are the familiar tungsten-thorium oxide cathode without reduction means, and the likewise familiar lanthanum hexaboride cathode, neither of which requires any reducing or other reacting components for the liberation of the monolayer-forming thorium or lanthanum for the supply reaction under operating conditions.

In the conversion cathodes the supply and liberation reaction in the operating condition of the cathode proceeds with the participation of a reaction component in the case of an oxide-reducing type cathode, e.g., with a carbon-containing reduction agent.

SUMMARY OF THE INVENTION

One subject of the present invention is to increase the emission current densities of the foregoing restricted type of reaction cathodes while maintaining a long lifetime. This object has now been attained by providing a cathode of the said type with the features discussed above, by the use of a compound of at least yttrium and/or lanthanum, as the monolayer former, and by the use of at least one of the metals palladium, platinum, rhodium or ruthenium as diffusion promoting agent.

DETAILED DESCRIPTION OF THE PREFERRED EMBODIMENTS

Figure 1:
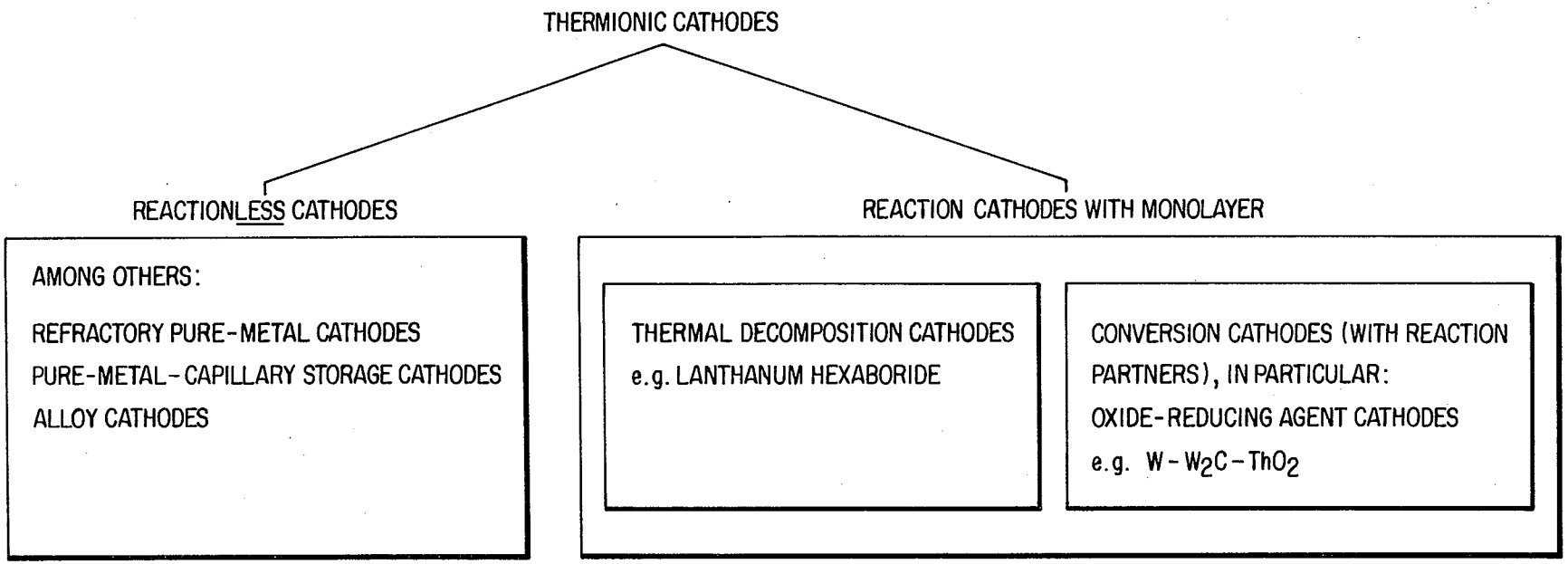
FIG. 1 is a schematic survey of different cathode types.

The basis of the invention, according to knowledge built up from extensive experimentation, is that the supply of the monolayer former to the cathode surface in reaction cathodes, in general, depends essentially on the transport of the element liberated by the reaction by grain boundary diffusion, which is not only enhanced by the aforementioned metals, Pd, Pt, Rh and Ru, but also can be stabily maintained over a long period of time under the operating conditions of the cathode. This essentially is the case for the reaction cathodes which do not have reaction components also, since here again the liberating reaction, i.e., in this case the thermal decomposition of the compound with the monolayer former, is not limited to the surface layer, but proceeds, more or less intensely, in the deeper regions also. Here again, therefore, the supply transport of the monolayer former by grain boundary diffusion is of importance. In contrast thereto, the supply of the monolayer former in the aforementioned capillary-storing cathodes does not depend significantly on diffusion in the grain boundaries or even on volume diffusion in the crystallites of the cathode material. Here the supply is effected instead mainly by diffusion or by flow of the monolayer former into the interstices of the cathode matrix so that there is no possibility for the diffusion-enhancing agent of this invention embedded in a solid body to work.

A preferred embodiment of this invention is based on the utilization of the said diffusion-enhancing agent for the special group of yttrium and lanthanum oxide reaction cathodes, in which the monolayer former is stored in an oxide and after liberation - regardless of whether by thermal decomposition or by conversion with a reducing agent — reaches the cathode surface by grain boundary diffusion. The excellent action of the diffusion-enhancing agent of the invention with respect to the long-term emission current density in the said oxide reaction cathodes is probably connected with an additional catalytic function of the said metals Pd, Pt, Rh and Ru in the reduction.

In particular, the invention can be used to advantage in yttrium- and lanthanum-oxide reducing agent cathodes, which thus belong to the subgroup of conversion cathodes in the above-defined senese. Thus, excellent values of emission current densities have been obtained with long lifetimes by the introduction of one or more of the diffusion-enhancing metals Pd, Pt, Rh, and Ru into the cathode system with a carbide of this binder metal as a reducing agent. Also, a further advance was achieved in that the power consumption in relation to emission current was reduced.

The preferred active substance of the cathode of the invention is a lanthanum compound (with reducing agent if appropriate) with a diffusion-enhancing agent of the aforementioned type, especially in combination with a binder of the refractory metal Mo, which, preferably for the abovedescribed realizations with a carbide of this metal as reducing agent, is recommended.

Having generally described the invention, a more complete understanding can be obtained by reference to certain specific examples, which are included for purposes of illustration only and are not intended to be limiting unless otherwise specified.

EXAMPLE 1

98% by weight molybdenum powder (grain size 1.2$\mu$ after Fisher subsieve sizes) was mixed for 30 minutes in a tumble mixer with 2% by weight of $La_2O_3$, which was first wet ground in a ball mill. The powder mixture was then passed, as the first step, in a cylindrical rubber mold in an isostatic press at a pressure of 3000 bar to form an unfinished piece. Next the piece was prereduced, in a second step, in flowing hydrogen at a temperature of 1000° C for 12 hours, in order to remove the oxygen from the molybdenum. In a third step the item was inductively heated to 1700° C for an hour in a vacuum melting oven filled with hydrogen and sintered to a density of 98% of the theoretical density. A ribbon with dimensions 5 × 1 × 12 mm was next separated from the sintered clump by spark erosion in a fourth step, and its surface polished. In a subsequent sixth step, the separated ribbon was coated with a 1 to 10$\mu$ thickness of platinum as diffusion-enhancing agent in a electrolytic bath. With this coating, the ribbon was subjected in the following seventh step of the process, to a diffusion annealing for several minutes in vacuum or in a protective atmosphere at 1300° C. After that the ribbon was carburized in an eighth step. For this, it was exposed to a benzene-hydrogen mixture for 10 minutes at 1700° C so as to form a molybdenum carbide layer ($Mo_2C$) between the platinum film and the molybdenumlanthanum oxide core. The electron emission current densities attained with this platinum-lanthanum oxide-molybdenum carbide-molybdenum cathode are shown in FIG. 2.

Figure 2:
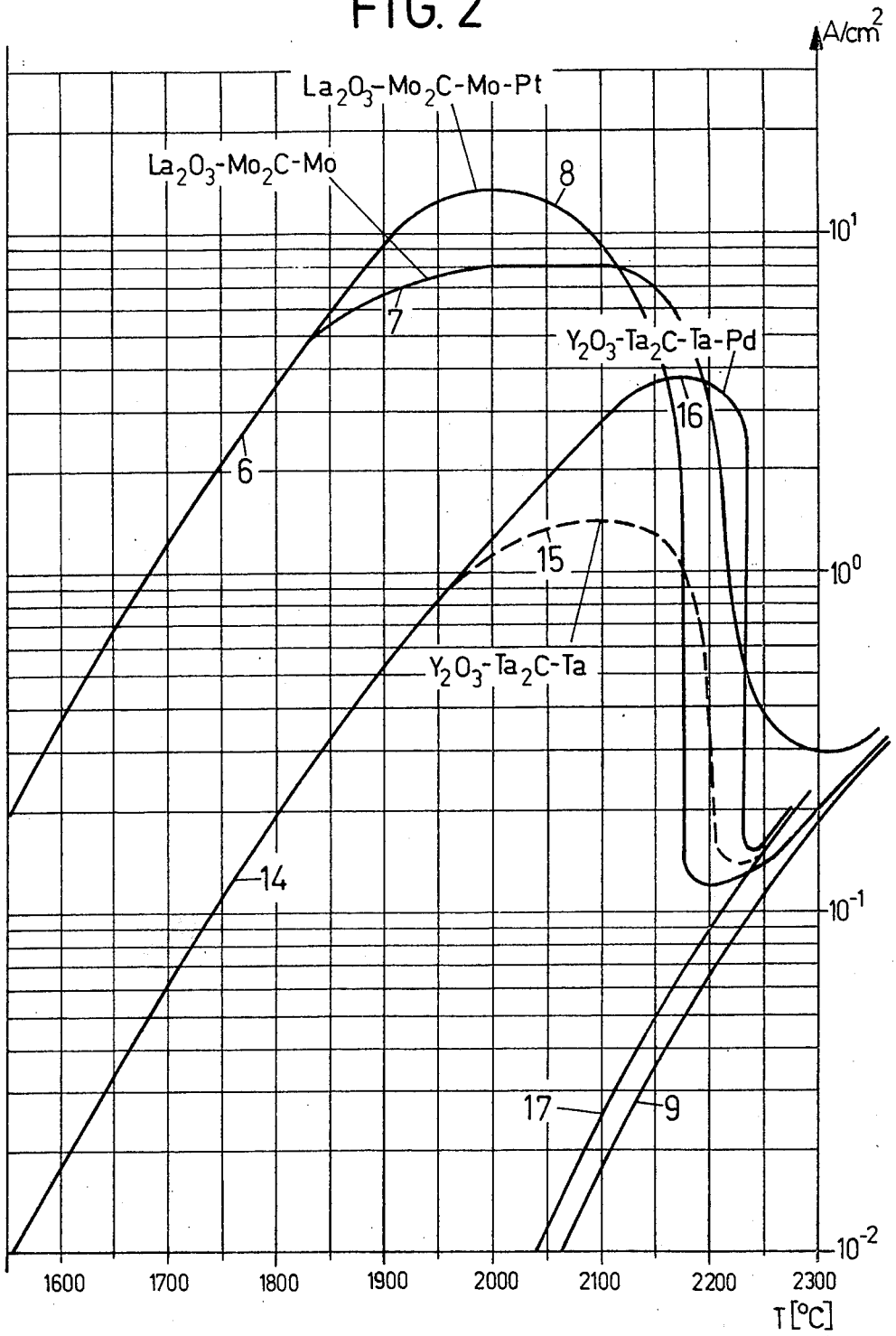
FIG. 2 illustrates emission current densities for the cathodes of Examples 1 and 4 with and without a diffusion-enhancing material.

The curve section 6 in FIG. 2 shows the variation of the electron emission current density, both for the cathode produced according to this example and for a similarly produced lathanum oxide-molybdenum oxide-molybdenum cathode without diffusion-enhancing material. In the region of curve section 6, the electron emission current densities are the same for both cathodes. At a temperature of 1830° K, the curve divides into two section 7 and 8. The curve section 7 shows that above a temperature of 2150° K the emission current density of the platinum-free cathode falls to that of the molybdenum-bearing one represented by the curve 9. The emission current density of the platinum-lathanum oxide-molybdenum carbide-molbdenum cathode follows the curve section 8. It thus exhibits, because of grain boundary diffusion enhancement, a significantly higher electron emission current density than the comparison cathode in the temperature range from 1830° to beyond 2100° K. This is to be attributed to the lathanum monolayer, stable because of enhanced diffusion-supply transport at higher temperatures and corresponding evaporation rates.

EXAMPLE 2

In this example the treatment at first was like that in Example 1. The difference was that the eighth step, i.e., the carburization with benzene and hydrogen, preceded the sixth step, i.e., the platinizing. The resultant electron emission current densities as functions of temperature agree with the results given in FIG. 2 by curve sections 6 and 8.

EXAMPLE 3

Molybdenum powder was mixed with 2% by weight $La_2O_3$ and 0.5% by weight platinum black of 0.5$\mu$ grain size. The mixture was isostatically compressed at 3000 bar to a rough piece as the first step of the treatment. In a second stage, the rough piece was reduced for five hours in flowing hydrogen at a temperature of 1000° C. After that, the piece was sintered for an hour at 1500° C, attaining 99.8% of the theoretical density. From the sintered clump, a ribbon of dimensions 5 × 1 × 12 mm was obtained by spark erosion in a fourth step. In a fifth step, the ribbon was carburized in a benzene-hydrogen mixture for 10 minutes at 1700° C. The electron emission current densities obtained with this ribbon as cathode likewise correspond to the values given in FIG. 2 by the curve sections 6 and 8.

EXAMPLE 4

High-purity tantalum powder of 1$\mu$ grain size was mixed with 2% by weight $Y_2O_3$-powder of 0.2$\mu$ grain size and then cold-pressed isostatically at 3000 bar to a rough piece, as the first step. In a second step, the rough piece was sintered to a clump for an hour at 23°–0° C under vacuum. A density of 89% of the theoretical density was reached. In a third step, a ribbon of dimensions 5 × 1 × 12 mm was obtained from the sintered clump by spark erosion. In a fourth step, the ribbon was carburized in a benzene-argon mixture for 14 minutes at 1700° C. A tantalum carbide layer is thereby formed on the ribbon surface. In a fifth step in treatment, a 10$\mu$ thick palladium coating was galvanically deposited on the ribbon. In a succeeding sixth step, the ribbon was annealed in a vacuum for 2 hours at 1600° C, whereby the palladium was diffused into the tantalum. The resultant yttrium oxidetantalum carbide-tantalum cathode with Pd as diffusion-enhancing agent exhibited the emission current densities shown in FIG. 2 by curve section 14. At temperatures up to 1970° K, the electron emission current density of curve section 14 is the same as that of a similarly produced yttrium oxide-tantalum carbide-tantalum cathode without a diffusion-enhancing agent. Curve section 16 shows that the yttrium oxide-tantalum carbide-tantalum-palladium cathode gives a higher electron emission current density above 1970° K because the palladium still maintains in this temperature range a satisfactory γ-monolayer, in spite of the higher evaporation rate, by a stronger diffusion supply of yttrium to the electrode surface than in the case of a palladium-free electrode. Only above 2200° K does the electron emission content density of the electrode with Pd fall and become equal to that of the pure tantalum shown by emission curve 17. In the palladium-free comparison electrode — curve section 15 — the activator impoverishment with consequent transition to saturation of the emission current already becomes evident at about 1970° K, and the drop to the Ta-emission curve 17 starts at about 2150° K. The saturation level of the electrode with palladium was more than double that of the palladium-free one. Further tests showed that there was a basic improvement in the electron emission current density obtainable without mobilizer in a selective combination using the metals molybdenum, tungsten and tantalum as carrier, with compounds of thorium, lanthanum and yttrium and with the metals palladium, platinum and ruthenium as diffusion-enhancing agent. All the cathodes of this type studied had a lifetime like that of the known thoriated tungsten cathode. In particular the molybdenum-lanthanum cathode demonstrated good workability into wires. Here one starts with a sintered mass which is then hammered round and finally drawn into the wire.

It is worth further investigation to find out how important the arrangement of the monolayer-forming compound and the diffusion-enhancing agent in or on the carrier is. In this connection, the following configurations were studied.

First, there was produced on the surface of a carrier composed of a refractory metal, a zone containing the monolayer-forming compound — with reducing agent if appropriate. Over this, the diffusion-enhancing agent was applied as outer zone. Although the latter is thus preferred to be contained in the outer layer, it carries out its specific function more or less in the interior, so that in general, penetration of the diffusion-enhancing agent into deeper zones of the cathode is necessary. This can be brought about by the diffusion annealing process during cathode fabrication as mentioned in Example 1.

Figure 3:
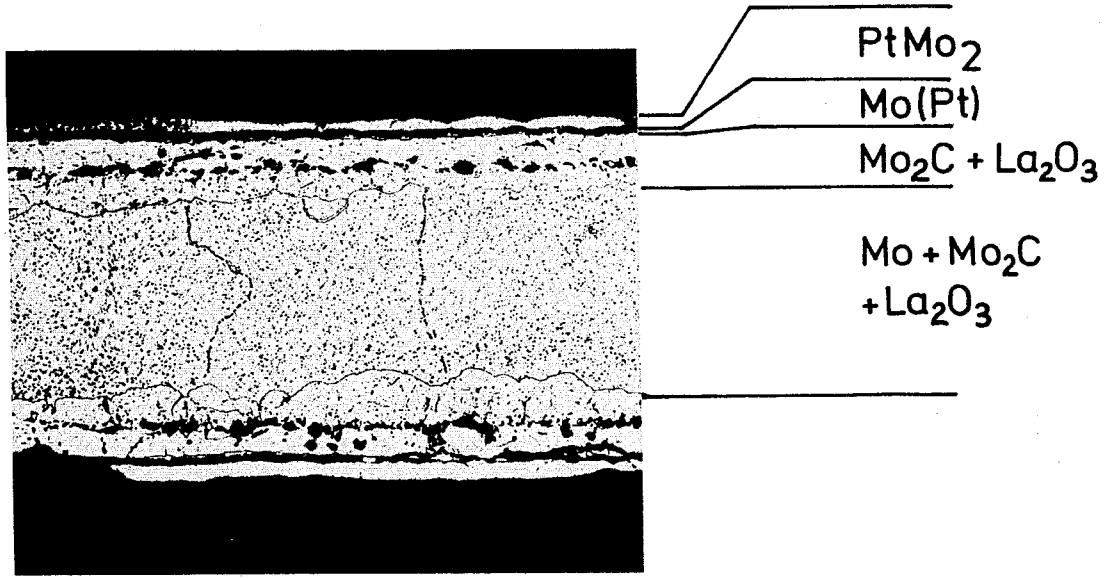
FIG. 3 illustrates a polished section of the instant cathode.
Figure 4:
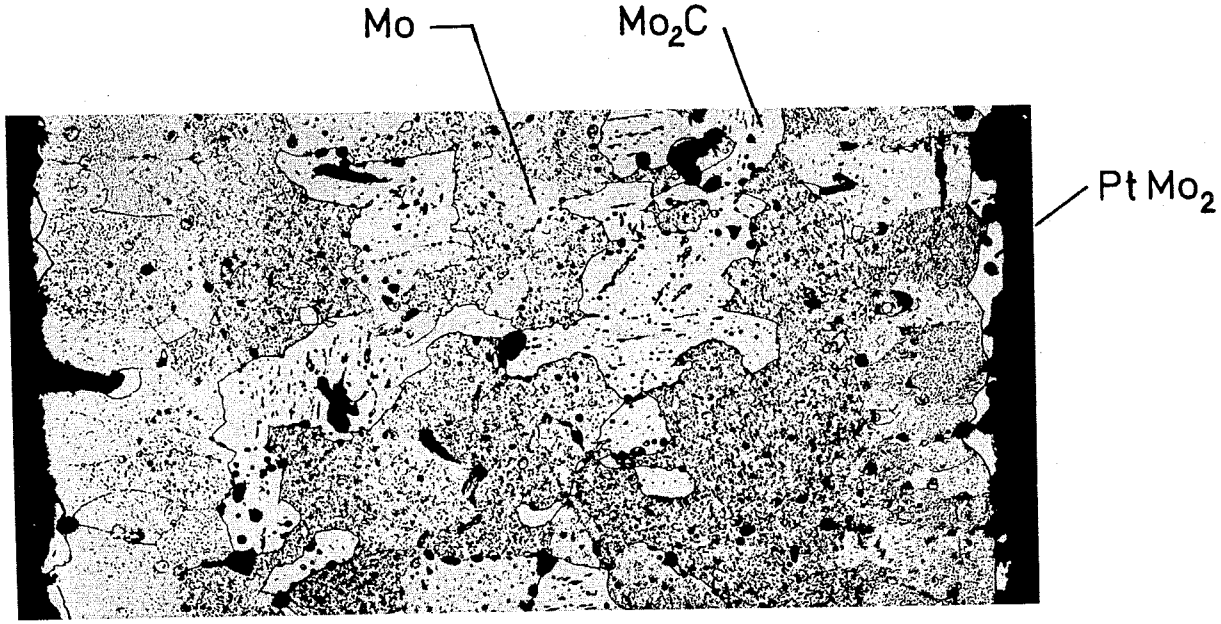
FIG. 4 illustrates the polished cathode after 2000 hours of operation.

FIG. 3 shows a longitudinal polished section of a cathode filament of platinum-lanthanum oxide-molybdenum carbide-molbydenum type with preferred platinum-containing outer layer in its condition at the start of operation, magnified 100 times, and FIG. 4 shows the corresponding polished section after 2000 hours of operation at 2000° K, magnified 200 times. These illustrate the absorption of the outer layer containing preferably the diffusion-enhancing agent and thereby the supply and protective functions of this outer layer.

In a second variant, a zone of the diffusion-enhancing agent was produced on the carrier surface and on it, the monolayer-forming compound was applied, so that the diffusion-enhancing agent is contained preferably in a middle zone. Here too in general, penetration of the diffusion-enhancing agent into the zone of the monolayer-forming compound is required. In both cases, there is available in the form of the layer containing the diffusion-enhancing agent, a supply sufficient to compensate the losses produced by evaporation during operation.

In a third variant, the diffusion-enhancing agent was dispersed in the carrier and the monolayer-forming compound applied preferably in an outer zone. In a fourth variant the monolayer-forming compound was dispersed in the carrier and the diffusion-enhancing agent located preferably in an outer zone. Both of there variants, particularly, the last mentioned, offer some advantages in the fabrication technique, but in general, a diffusion annealing process for the penetration of the diffusion-enhancing agent into the region of the monolayer-forming compound is required. In a fifth variant, both the activator and the mobilizer were dispersed in the carrier. This configuration is optimal with regard to working the material.

With respect to the quantitative composition of the cathodes, the following advantageous content ranges for the monolayer-forming compound and the diffusion-enhancing agent were established:

Monolayer-forming compound: 0.05–10% by weight
Diffusion-enhancing agent: 0.01–5% by weight The optimal values with respect to electron emission current density, lifetime and workability of the cathode material into wire were found to be:

Activator chemical compound: 0.5–3% by weight
Mobilizer: 0.3–0.6% by weight

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. In a reaction cathode with high thermic emission, which is especially suited for vacuum tube application, and which comprises a carrier body consisting of crystallite grains and a compound of a monolayer-forming element, which compound is liberated by a continuous supply reaction and transported to the emitting surface of the cathode by diffusion through the volume, the grain boundaries or in both the volume and the grain boundaries of said carrier body during the operation of the cathode, the improvement wherein the monolayer-forming element is at least one of the elements selected from the group consisting of yttrium and lathanum and wherein said cathode further contains at least one metal selected from the group consisting of palladium, platinum, rhodium and ruthenium, as a solid state diffusion-enhancing dispersed in the volume, in the grain boundaries or in both the volume and the grain boundaries of said carrier body together with said compound of the monolayer-forming element.

2. The reaction cathode of claim 1, wherein said monolayer forming element is present in the form of an oxide.

3. The reaction cathode of claim 2, wherein said cathode contains a reducing agent which is effective at the cathode operating temperature to reduce the said oxide when the monolayer forming element is present in the form of an oxide.

4. The reaction cathode of claim 3, wherein said reducing agent is a carbide.

5. The reaction cathode of claim 4, wherein said carbide is at least one carbide of the metals molybdenum or tantalum.

6. The reaction cathode of claim 1, wherein said carrier body contains as a carrier element at least one of the metals molybdenum and tantalum.

7. The reaction cathode of claim 1, which contains from 0.2–15% by weight of a compound of the monolayer former and 0.01–0.75% by weight of the diffusion-enhancing agent.

8. The reaction cathode of claim 7, wherein the compound of the monolayer former is present in an amount of 0.2 to 3%.

9. The reaction cathode of claim 7, wherein the diffusion-enhancing agent is present in an amount of 0.25 to 0.75% by weight.

10. The reaction cathode of claim 7, wherein the diffusion-enhancing agent is present in an amount of from 0.01 to 0.6% by weight.

* * * * *